US006696151B2

(12) United States Patent
Rim et al.

(10) Patent No.: US 6,696,151 B2
(45) Date of Patent: Feb. 24, 2004

(54) HIGH-DPF YARNS WITH IMPROVED FATIGUE

(75) Inventors: Peter Bryan Rim, Midlothian, VA (US); Farangis Kiani, Longwy (FR)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/307,630

(22) Filed: Dec. 2, 2002

(65) Prior Publication Data

US 2003/0143394 A1 Jul. 31, 2003

Related U.S. Application Data

(60) Provisional application No. 60/352,411, filed on Jan. 28, 2002.

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS

| | | | | |
|---|---|---|---|---|
| 4,101,525 | A | 7/1978 | Davis et al. | 528/309 |
| 4,348,517 | A | 9/1982 | Chakravarti | 523/425 |
| 4,355,132 | A | 10/1982 | East et al. | 524/602 |
| 4,414,169 | A | 11/1983 | McClary | 264/210.7 |
| 4,462,855 | A | 7/1984 | Yankowsky et al. | 156/307.3 |
| 4,475,330 | A | 10/1984 | Kimura et al. | 57/245 |
| 4,557,967 | A | 12/1985 | Willemson et al. | 428/224 |
| 4,851,172 | A | 7/1989 | Rowan et al. | 264/130 |
| 4,867,936 | A | 9/1989 | Buyalos et al. | 264/210.6 |
| 4,929,760 | A | 5/1990 | Kitazume et al. | 568/308 |
| 4,975,326 | A | 12/1990 | Buyalos et al. | 428/373 |
| 5,067,538 | A | 11/1991 | Nelson et al. | 152/451 |
| 5,085,818 | A | 2/1992 | Hamlyn et al. | 264/210.6 |
| 5,132,067 | A | 7/1992 | Nelson et al. | 264/210.8 |
| 5,234,764 | A | 8/1993 | Nelson et al. | 428/364 |
| 5,238,740 | A | 8/1993 | Simons et al. | 428/364 |
| 5,285,623 | A | 2/1994 | Baillievier et al. | 57/236 |
| 5,397,527 | A | 3/1995 | Rim et al. | 264/210.8 |
| 5,547,755 | A | 8/1996 | Reinthaler et al. | 428/364 |
| 5,630,976 | A | 5/1997 | Nelson et al. | 264/210.8 |
| RE36,698 | E | 5/2000 | Kim et al. | 428/364 |

*Primary Examiner*—N. Edwards
(74) *Attorney, Agent, or Firm*—Margaret S. Millikin; Virginia Szigeti

(57) ABSTRACT

A product comprises a dimensionally stable polymeric multifilament yarn having a decitex per fiber count DPF of at least 7.5 and a fatigue strength retention FR, wherein preferred yarns are spun and drawn such that FR increases when DPF increases. Particularly preferred yarns are fabricated from poly(ethylene terephthalate) and have a DPF of between 10 and 20.

8 Claims, 1 Drawing Sheet

HIGH-DPF YARNS WITH IMPROVED FATIGUE

CROSS-REFERENCE TO RELATED APPLICATIONS

This application claims priority to pending U.S. provisional application Ser. No. 60/352,411, filed Jan. 28, 2002, the entire contents of which are incorporated by reference.

FIELD OF THE INVENTION

The field of the invention is dimensionally stable yarns.

BACKGROUND OF THE INVENTION

Polyester multifilament yarns have found widespread use in various applications, and with increasing demands on mechanical performance of such fibers various high-strength polyester yarns have been developed with, among other improved parameters, relatively high modulus and relatively low free shrinkage.

For example, Nelson et al. describe in U.S. Pat. Nos. 5,067,538 and 5,234,764 methods and compositions for a polyester multifilament yarn having a dimensional stability of $E_{4.5}$+FS of less than 11.5% and a terminal modulus of above about 20 g/d. Among other desirable qualities, Nelson's yarns can typically be employed in environments with relatively high temperatures (here: 80–120° C.). Furthermore, crystallization of the poly(ethylene terephthalate) (PET) in Nelson's yarns appears to occur during spinning, thereby potentially rendering at least some of the desired mechanical qualities of the yarn independent from fluctuations during drawing.

In another example, Rim et al. describe in U.S. Pat. No. 5,397,527 methods for producing a multifilament yarn fabricated from poly(ethylene naphthalate) (PEN) or other semi-crystalline polyester having a dimensional stability (EASL+Shrinkage) of less than 5% and a tenacity of at least 6.5 g/d. Rim's yarns advantageously improve several mechanical qualities of previously known PEN yarns and may even be produced using equipment without high-speed spinning capability. However, in order to achieve most of the improvements in mechanical quality, the chemical composition of such yarns is typically limited to PEN or compositions with high quantities of PEN.

In a further example, U.S. Pat. No. 5,238,740 to Simons et al. a polyester yarn with a tenacity of at least 10 g/d and a shrinkage of less than 8% is produced by passing the spun filaments through a heated and insulated column in which a particular temperature profile is employed in combination with relatively high take-up speeds to obtain the desired improved mechanical properties. While Simons' methods generally produce yarns with a relatively high tenacity and a relatively high secant modulus (greater than 150 g/d/100%) at a comparably low shrinkage, relatively expensive equipment and additional process controls for the heated column are generally required.

Although various compositions and methods for production of dimensionally stable yarns are known in the art, all or almost all of them require moderate to high cord twist for use in demanding fatigue applications such as tires. While global requirements for fatigue resistance have become increasingly stringent, there has not been the commensurate improvement in fatigue resistance to avoid the need for higher twist in the most demanding applications. There have been various approaches to improve fatigue resistance in dimensionally stable yarns (see e.g., U.S. Pat. No. 4,101,525 to Davis, U.S. Pat. No. 4,975,326 to Buylous, U.S. Pat. No. 4,355,132 to East, U.S. Pat. No. 4,414,169 to McClary, and RE 36,698 to Kim). However, all or almost all past attempts have focused on yarns with a DPF of lower than 5 since it was generally believed that increasing DPF decreases fatigue resistance (see e.g., Baillievier U.S. Pat. No. 5,285,623). Furthermore, it is believed that in many yarns fatigue strength retention tends to decrease or remain substantially the same as the filament count increases.

Also, PET treated cords have been produced using Hoechst T748 with a DPF of 7.2, which exhibited similar fatigue resistance when compared to treated cords from a 4.8 DPF yarn. Thus, there is still a need to provide compositions and methods for production of dimensionally stable yarns with improved fatigue strength retention characteristics.

SUMMARY OF THE INVENTION

The present invention is directed to compositions and methods for products comprising a dimensionally stable polymeric multifilament yarn with a DPF (decitex [1 denier= 1.1 decitex] per number of filaments) of at least 7.5. Especially contemplated yarns include those having a fatigue strength retention FR, wherein the yarn is spun and drawn such that FR increases when DPF increases.

In one aspect of the inventive subject matter, contemplated yarns have a DPF of between about 10 and 20, and comprise a polyester, preferably poly(ethylene terephthalate). It is further contemplated that such yarns have a dimensional stability defined by $E_x$+TS of no more than 12, more preferably of no more than 11, and that the increase in strength retention per DPF in the contemplated yarns is no less than 1%. Typically, first generation yarns have $E_x$+TS in the range of 11–12, and later improved versions are lower. $E_x$ is the elongation at x stress for the yarn, where x is 41 cN/tex or, for example, 45 N for 1100 decitex yarn, 58 N for 1440 decitex yarn, 67 N for 1650 decitex yarn, and 89 for 2200 dtex yarn. TS is thermal shrinkage.

In another aspect of the inventive subject matter, contemplated yarns are twisted into a cord or twisted as single yarns that are at least partially disposed within a rubber.

In a further aspect of the inventive subject matter, a method of forming a yarn has one step in which a polymeric material is provided and spun into a plurality of filaments. In a further step, a dimensionally stable yarn is drawn from the plurality of filaments, wherein the yarn has a decitex per filament count DPF of at least 7.5 and a fatigue strength retention FR, and wherein the yarn is spun and drawn such that FR increases when DPF increases.

Various objects, features, aspects and advantages of the present invention will become more apparent from the following detailed description of preferred embodiments of the invention, along with the accompanying drawing.

DETAILED DESCRIPTION

Figure 1:
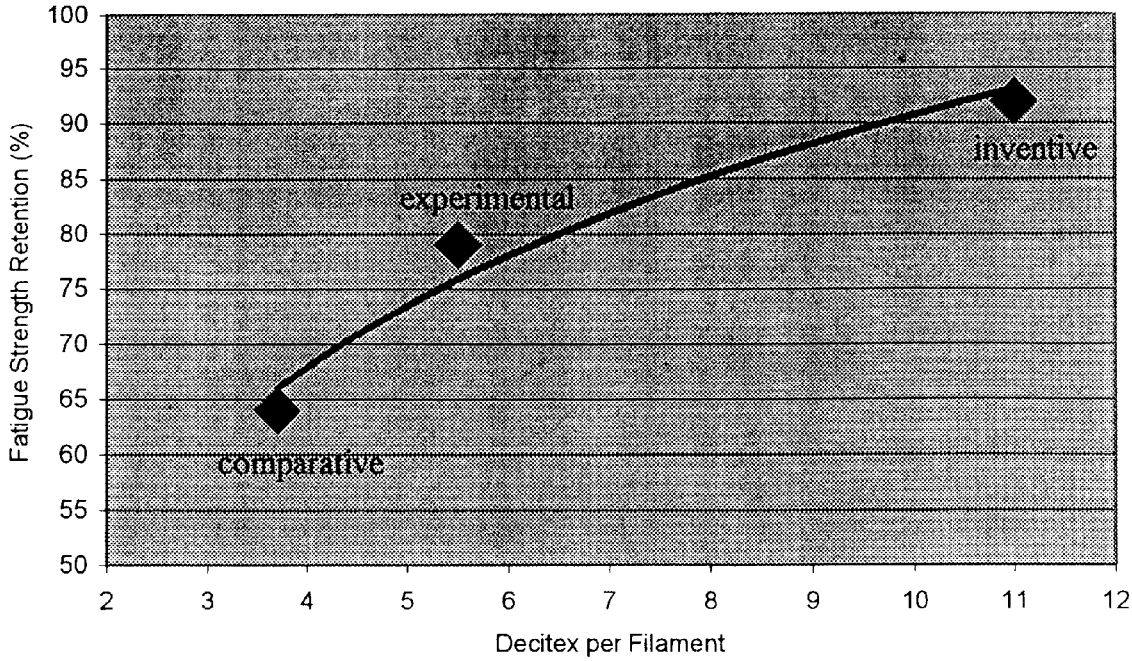
FIG. 1 shows the fatigue Strength retention vs. The dectex per fialment.

The inventors have surprisingly discovered that dimensionally stable yarns with excellent fatigue resistance can be produced from a plurality of polymeric filaments with a DPF of at least 7.5. In further preferred aspects, the yarn is spun and drawn such that the fatigue strength retention of the yarn increases when DPF increases.

In an especially preferred aspect of the inventive subject matter, a yarn with 11 decitex per filament was produced by extruding a polyester (most preferably poly(ethylene terephthalate)) from a spinneret into a plurality of individual filaments at a predetermined extrusion rate (typically between about 25.0–80.0 kg/hr) into a gaseous delay zone. The filaments are subsequently solidified in a gaseous quenching column to form an undrawn dimensionally stable yarn with a birefringence of between about 0.02 to about 0.15, and more preferably between about 0.05 to 0.09. The undrawn yarn is then continuously transported to a series of draw rolls where it is drawn to within 85%, preferably within 90%, of its maximum draw ratio at yarn temperatures between about 70° C. and about 250° C. Typical processes and equipment are described in U.S. Pat. No. 5,630,976; U.S. Pat. No. 5,132,067; U.S. Pat. No. 4,867,936; and U.S. Pat. No. 4,851,172.

With respect to the polymer it is contemplated that numerous polymers are suitable for use in conjunction with the teachings presented herein, however, particularly preferred polymers include various polyesters, and especially poly(ethylene terephthalate). The intrinsic viscosity of preferred polymers is at least 0.7, more typically at least between about 0.85 and about 0.98, and in some cases between about 0.99 and about 1.30, and even higher.

Depending on the desired number of filaments in the yarn, the configuration of contemplated spinnerets used in the melt extrusion process will vary considerably. It is generally contemplated that the number of orifices in the spin pack is not limiting to the inventive subject matter and may thus be most typically between 20 and 150 for 1100 decitex yarns and proportionate to achieve equal DPF for other decitex yarns. However, where yarns with relatively low filament count are desirable, the number of orifices may be between 5 and 20. Similarly, where yarns with relatively high filament count are desirable, the number of orifices may be between 200 and 400, and even more for higher decitex yarns.

With respect to the orifice diameter, it is generally contemplated that numerous diameters are suitable for spinning contemplated fibers, and the choice of a particular diameter will depend at least in part on the desired physical properties of the fiber. For example, contemplated orifice diameters include diameters between 0.8–2.3 mm, and even more. Further exemplary suitable orifice parameters may be found in U.S. Pat. No. 5,085,818 to Hamlyn et al., which is incorporated by reference herein.

It should further be appreciated that suitable polymeric multifilament yarns need not be restricted to yarns with 11 decitex/filament, but may also include a dimensionally stable polymeric multifilament yarn having a decitex per fiber count DPF of at least 7.5, more preferably of at least 9, even more preferably of at least 10, and most preferably of at least 12, so long as contemplated polymeric multifilament yarns are dimensionally stable. Thus, especially contemplated dimensionally stable yarns may have a DPF between 10 and 20. The term "dimensionally stable yarn" as used herein means that suitable yarns will have a dimensional stability defined by $E_x$+TS of no more than 12, and more preferably a dimensional stability defined by $E_x$+TS of no more than 11.

It is further contemplated that the filaments are spun into a delayed quench, and particularly contemplated that the temperatures of the gaseous atmosphere in the delayed quench are generally above 250° C. Solidification of the extruded filaments is preferably performed in an air quenching column at a quench rate of preferably between about 10 mm ($H_2O$) and about 70 mm ($H_2O$). However, it should be appreciated that numerous quench rates below 10 mm ($H_2O$) and above 70 mm ($H_2O$) are also suitable (e.g., 2–10 mm and less, or 70–120 mm and even more)

Thus, it should be appreciated that the undrawn yarn that is formed by contemplated filaments will be a dimensionally stable yarn precursor with a birefringence Δn of at least 0.020, so long as such Δn values are indicative of dimensional stability of at least first generation.

In further contemplated aspects of this inventive subject matter, an adhesion active overfinish may be applied to the undrawn yarn, the drawn yarn, or both. Typical adhesion active finish additives include polyglycidyl ethers (U.S. Pat. Nos. 4,462,855; 4,557,967; and 5,547,755, all of which are incorporated by reference herein), multifunctional epoxy silanes (U.S. Pat. No. 4,348,517, incorporated by reference herein), and additives which form epoxides in situ (U.S. Pat. No. 4,929,760, incorporated by reference herein).

In still further contemplated aspects of the inventive subject matter, contemplated undrawn yarns are drawn in a series of draw rolls, and a typical draw configuration includes four to five roll pairs $Z_1$-$Z_5$. While $Z_1$ may be heated to various temperatures, it is generally preferred that $Z_1$ is heated to between about 20° C. and 120° C., more preferably between about 40° C. and 80° C. Temperature of $Z_3$ may vary widely from 60° C. to 250° C. depending on whether $Z_4$ has much higher speed (stretching between rolls) or similar speed (primarily heat-setting between rolls). Lower temperatures are preferred where substantial additional stretching occurs between the rolls. With respect to the final godet roll pair, $Z_4$ (for 4-roll pair panel) or $Z_5$ (5 roll pair panel), it is contemplated that preferred temperatures are in the range of about 120° C. to 160° C. Contemplated draw ratios of the multifilament fibers will typically be in the range of about 1.2–2.5. Further especially suitable materials and spinning/drawing conditions are described in U.S. Pat. Nos. 5,067,538 and 5,234,764 to Nelson, both of which are incorporated by reference herein.

In a further contemplated aspect of the inventive subject matter, contemplated yarns may be twisted into cords of various configurations using procedures and equipment well known in the art. For example, especially contemplated configurations include 1100/2 decitex cords with relatively low twist of between 270×270 to 320×320 to cords with relatively high twist of between 420×420 to 470×470 (and even higher). Equivalent twists for other deniers can be determined by keeping the twist multiplier constant (Sqrt (nominal cord decitex)×twist(tpm)).

Thus, a method of forming a yarn may comprise a step in which a polymeric material is provided and a plurality of filaments is spun from the polymeric material. In another step, a dimensionally stable yarn is drawn from the plurality of filaments, wherein the yarn has a decitex per fiber count DPF of at least 7.5 and a fatigue strength retention FR, wherein the yarn is spun and drawn such that FR increases when DPF increases. Such prepared cords may find use in numerous applications and products, and particularly suitable applications and products include power transmission belts, automobile tires, safety belts, parachute harnesses and lines, cargo handling and safety nets, etc.

EXAMPLES

The following examples are provided to illustrate various aspects of the inventive subject matter, and it should be appreciated that one or more of the parameters may be modified without departing from the inventive concept presented herein.

A 1100 decitex polyester (here: PET) yarn with 11 decitex/filament was produced by extruding one hundred individual filaments through 0.762 mm spinneret holes at 33.5 kg/hr into a 5.08 cm heated sleeve at 450° C., followed by solidifying into an air quenching column. The so produced undrawn yarn had a birefringence of 0.083, which is characteristic of dimensional stability of at least second generation. The undrawn yarn was continuously transported to a series of draw rolls and drawn under conditions as summarized in Table 1 to yield a yarn having the properties as listed in Table 2.

TABLE 1

Drawing Conditions

| | | | |
|---|---|---|---|
| Roll Pair 1 Temp. (° C.) | 70 | Roll Pair 4 Temp. (° C.) | 245 |
| Roll Pair 1 Speed (m/min) | 2900 | Roll Pair 4 Speed (m/min) | 5130 |
| Roll Pair 2 Temp. (° C.) | 45–50 | Roll Pair 5 Temp. (° C.) | 130 |
| Roll Pair 2 Speed (m/min) | 3900 | Roll Pair 5 Speed (m/min) | 5076 |
| Roll Pair 3 Temp. (° C.) | 240 | | |
| Roll Pair 3 Speed (m/min) | 5235 | | |

TABLE 2

Drawn Yarn

| | |
|---|---|
| Denier | 1118 |
| Break Strength | 71.3 |
| Elongation at 45 N | 5.25 |
| Ultimate Elongation | 10.2 |
| Shrinkage at 177° C. | 3.5 |

An adhesive overfinish was applied to the yarn after the drawing step and the yarn was twisted into 1100/2 cords of different twist as indicated in below. An adhesive coating application was then performed by dip coating the cord in ammoniated resorcinol formaldehyde adhesive, followed by subsequent stretching in a first oven at room temperature at 2.4N for 10 sec, in a second oven at room temperature at 2.4N for 10 sec, in a third oven at 177° C. at 2.4N for 30 sec, and in a fourth oven at 240° C. at a tension and time sufficient to obtain desired shrinkage of between about 1.0% to 2.0%, more preferably 1.4% to 1.8%, and most preferably about 1.6% (tension and time will have to be adjusted for a particular denier). Flexural fatigue was performed on the adhesive treated cords, after being cured into rubber to form a composite as described below. Testing conditions were a 15 mm pulley, a load of 70 kg, a test frequency of 200 cycles/min, and 40000 cycles duration. After fatiguing, the cords were removed from the rubber, and the percent retention of breaking strength was determined relative to cords removed from a control composite specimen. The treated cord properties and the fatigue results are compared in Tables 3 and 4 to treated cords, prepared the same way, from a control yarn (5.5 decitex/filament yarn (Honeywell 1×53—1100 dtex with 200 filaments)). These results show a significant improvement in fatigue retention for the yarns of this invention. It should especially be appreciated that the treated cord dimensional stability, as measured by the sum of Elongation at 45N and Shrinkage at 185° C., is close to that of 1×53, a third generation dimensionally stable material.

TABLE 3

Treated Cord Properties

| Twist-single × cable (tpm) | Property | Example 1 | Control (1X53) |
|---|---|---|---|
| 320 × 320 | Breaking Strength (daN) | 13 | 14.9 |
| 320 × 320 | Ultimate Elongation (%) | 12.2 | 13.9 |
| 320 × 320 | Elongation at 45 N (%) | 4 | 3.8 |
| 320 × 320 | Shrinkage at 185° C. (%) | 1.7 | 1.6 |
| 320 × 320 | Dimensional Stability | 5.7 | 5.4 |
| 350 × 350 | Breaking Strength (daN) | 13.1 | 14.8 |
| 350 × 350 | Ultimate Elongation (%) | 13.2 | 15 |
| 350 × 350 | Elongation at 45 N (%) | 4.4 | 4.1 |
| 350 × 350 | Shrinkage at 185° C. (%) | 1.7 | 1.5 |
| 350 × 350 | Dimensional Stability | 6.1 | 5.6 |
| 370 × 370 | Breaking Strength (daN) | 12.8 | 14.3 |
| 370 × 370 | Ultimate Elongation (%) | 14 | 14.8 |
| 370 × 370 | Elongation at 45 N (%) | 4.6 | 4.3 |
| 370 × 370 | Shrinkage at 185° C. (%) | 1.6 | 1.6 |
| 370 × 370 | Dimensional Stability | 6.2 | 5.9 |
| 380 × 380 | Breaking Strength (daN) | 12.9 | 14.5 |
| 380 × 380 | Ultimate Elongation (%) | 14.6 | 15.4 |
| 380 × 380 | Elongation at 45 N (%) | 4.8 | 4.4 |
| 380 × 380 | Shrinkage at 185° C. (%) | 1.7 | 16 |
| 380 × 380 | Dimensional Stability | 6.5 | 6 |
| 400 × 400 | Breaking Strength (daN) | 12.6 | 14.5 |
| 400 × 400 | Ultimate Elongation (%) | 14.1 | 16.1 |
| 400 × 400 | Elongation at 45 N (%) | 4.9 | 4.6 |
| 400 × 400 | Shrinkage at 185° C. (%) | 1.8 | 1.6 |
| 400 × 400 | Dimensional Stability | 6.7 | 6.2 |
| 420 × 420 | Breaking Strength (daN) | 11.9 | 14.1 |
| 420 × 420 | Ultimate Elongation (%) | 13.6 | 15.4 |
| 420 × 420 | Elongation at 45 N (%) | 5.1 | 4.7 |
| 420 × 420 | Shrinkage at 185° C. (%) | 1.6 | 1.4 |
| 420 × 420 | Dimensional Stability | 6.7 | 6.1 |
| 440 × 440 | Breaking Strength (daN) | 12.6 | 14 |
| 440 × 440 | Ultimate Elongation (%) | 15.2 | 15.4 |
| 440 × 440 | Elongation at 45 N (%) | 5.3 | 4.8 |
| 440 × 440 | Shrinkage at 185° C. (%) | 1.8 | 1.8 |
| 440 × 440 | Dimensional Stability | 7.1 | 6.6 |
| 470 × 470 | Breaking Strength (daN) | 11.6 | 13.9 |
| 470 × 470 | Ultimate Elongation (%) | 14.6 | 16.1 |
| 470 × 470 | Elongation at 45 N (%) | 5.9 | 5.1 |
| 470 × 470 | Shrinkage at 185° C. (%) | 1.8 | 1.9 |
| 470 × 470 | Dimensional Stability | 7.7 | 7 |

TABLE 4

Fatigue Strength Retention (%)

| Twist single × cable (tpm) | Example 1 (% absolute) | Control (1X53) (% absolute) | Difference % Increase |
|---|---|---|---|
| 320 × 320 | 36 | 29 | 24 |
| 350 × 350 | 43 | 32 | 34 |
| 370 × 370 | 59 | 47 | 26 |
| 380 × 380 | 69 | 49 | 41 |
| 400 × 400 | 74 | 61 | 21 |
| 420 × 420 | 90 | 71 | 27 |
| 440 × 440 | 88 | 82 | 7 |
| 470 × 470 | 97 | 95 | 2 |

In summary, the 11 decitex/filament yarn as described above was twisted into (a) 1100/2 cords of 470*470 twist (twist multiplier is 22043) having a treated cord strength retention of at least 96% absolute, (b) 1100/2 cords of 440*440 twist (twist multiplier is 20636) having a treated cord strength retention of at least 85% absolute, and (c) 1100/2 cords of 400*400 twist (twist multiplier is 18760) having a treated cord strength retention of at least 70% absolute. Thus, especially contemplated products include those comprising a dimensionally stable polymeric multifilament yarn having a decitex per filament of at least 7.5 and a treated cord strength retention of at least 70% absolute for a twist multiplier of 18760, a treated cord strength retention of at least 85% absolute for a twist multiplier of 20636, or a treated cord strength retention of at least 96% absolute for a twist multiplier of 22043.

Thus, it should be recognized that products may be fabricated that include a dimensionally stable polymeric multifilament yarn having a decitex per fiber count DPF of at least 7.5. Preferred multifilament yarns comprise a polyester (e.g., PET) and will have a DPF between 10 and 20. Furthermore, while particular constructions of contemplated yarns are presented herein (e.g., the yarn is twisted in a 2-ply cord with a twist (single×cable TPM) of 320×320 to 470×470 for an 1100 decitex yarn), it should be appreciated that alternative cord constructions with equal twist multipliers are also contemplated.

In another experiment, the 11 decitex/filament yarn as described above was twisted into 1100/2 cords of 420×420. An adhesive treating condition identical to the coating process described above was employed, and treated cord strength retention was determined as described below. The treated cord properties and fatigue results are depicted below in Table 5, in which the 1100/2 cords 420×420 twist (Example 2) are compared to treated cords prepared using the same protocol to form a 5.5 decitex/filament yarn (Honeywell 1×53-200 filaments—Experimental) and a 3.7 decitex/filament yarn (Honeywell 1×53-300 filaments—Comparative [reference yarn]), which was prepared as internal standard. The fatigue results (70 kg load, 30,000 cycles) from Table 5 and Graph 1 (representing data from Table 5) show that a continuous improvement in fatigue occurs as the decitex per filament is increased. Especially contemplated yarns may be incorporated into a wide variety of products. Therefore, contemplated products will include a dimensionally stable polymeric multifilament yarn having a decitex per fiber count DPF of at least 7.5 and a fatigue strength retention FR, wherein the yarn is spun and drawn such that when DPF increases at least 100% over a reference yarn, FR increases at least 19% absolute over the reference yarn, and wherein the reference yarn has a fatigue strength retention of 64% and a DPF of 3.7 with a twist multiplier of 19700 (the reference yarn is commercially available Honeywell 1×53-300 filaments, see "Comparative" above). With respect to the test conditions to achieve the particular values of the reference yarn (i.e., fatigue strength retention of 64%, DPF of 3.7 with a twist multiplier of 19700), the test conditions as described below apply.

TABLE 5

| Property | Twist (single × cable (tpm)) | Example 2 Inventive | 1X53-200 Experimental | 1X53-300 Comparative |
|---|---|---|---|---|
| Decitex per Filament | –/– | 11.0 | 5.5 | 3.7 |
| Breaking Strength (daN) | 420 × 420 | 12.5 | 14.5 | 14.3 |
| Ultimate Elongation (%) | 420 × 420 | 13.5 | 15.5 | 15.9 |
| Elongation at 45N (%) | 420 × 420 | 4.7 | 4.4 | 4.4 |
| Shrinkage at 185° C. (%) | 420 × 420 | 1.9 | 1.8 | 1.7 |
| Dimensional Stability | 420 × 420 | 6.6 | 6.2 | 6.1 |
| Fatigue Strength Retention (%) | 420 × 420 | 92 | 79 | 64 |

Consequently, the inventors contemplate that dimensionally stable polymeric yarns according to the inventive subject matter may have a decitex per filament of at least 7.5 and a treated cord strength retention of at least 70% absolute for a twist multiplier of approximately 18760, more preferably a decitex per filament of at least 7.5 and a treated cord strength retention of at least 85% absolute for a twist multiplier of approximately 20636, and most preferably a decitex per filament of at least 7.5 and a treated cord strength retention of at least 96% absolute for a twist multiplier of approximately 22043, wherein the term "twist multiplier" as used herein is defined as sqrt (nominal cord decitex) * twist in TPM. Furthermore, it should be appreciated that while the yarn in the example in Table 5 is twisted into a cord with a twist of 420×420, alternative twists are also contemplated and include twists between 320 and 470, especially for an 1100 decitex yarn.

Thus, it should be appreciated that contemplated yarns (and particularly yarns fabricated from poly(ethylene terephthalate), which preferably have a DPF of between about 10 and 20) are spun and drawn such that the fatigue strength increases as DPF increases (e.g., with a fatigue strength retention increase per DPF of no less than 1%). While a person of ordinary skill in the art would expect that FR decreases as DPF increases (e.g., due to skin-core effect during quenching), the inventors surprisingly found that yarns can be spun such that when DPF increases at least 100% over a reference yarn having a DPF of 3.7 and a fatigue strength retention of 64%, FR will increase at least 19% absolute over the reference yarn. Thus, it should be recognized that dimensionally stable yarns can be spun and drawn such that the FR increases when DPF increases.

Unless indicated otherwise, the breaking strength, ultimate elongation and elongation at XN were determined following standard procedures on the yarn using a Statimat type FPM/M instrument, and on the treated cord using an Instron type 4466 (ASTM: D885-84). The distance between the jaws is 254 mm and the traction speed is 305 mm/min. Thermal shrinkage was determined using a Testrite (Model NK5) instrument with the following procedure: To one end of the sample, a weight equal to ((decitex)×0.05 g) is attached, and the sample is transferred into the instrument at the desired temperature for 120 sec. Dimensional stability is expressed as the sum of the elongation at x N and thermal shrinkage at 177° C. for the yarns.

Unless indicated otherwise, the treated cord strength retention was evaluated in a flex fatigue endurance test as follows (3-step procedure including (1) sample preparation, (2) endurance test, and (3) measurement of strength and calculation):

Sample preparation: The flex samples are prepared in a sandwich made with rubber, Kevlar, polyester and treated cord. The dimension of the sample is 17.5 cm×51 cm with 9 different layers as follows: Rubber (2.2 mm)+rubber (0.43 mm)+Kevlar layer+rubber (0.43 mm)+polyester film+rubber (0.43 mm)+treated cord polyester under study putting in parallel to cover all the sample surface (28 ends/2.54 cm)+rubber (0.43 mm)+Rubber (0.9 mm). The sample prepared is vulcanized at 171° C. for 20 minutes under a load of 78.5N. After the vulcanization the sample are kept at room temperature before the flexing endurance test. The sample is cut into five samples of 2.54 cm width. The sample from the middle is kept at room temperature as reference while the remaining four samples are submitted to the flex endurance test.

Flex endurance test: The 4 samples are put on the 4 pulley of 15 mm diameter. A load of 70 kg is adjusted for each sample. The flex fatigue machine is programmable articulated machine. When the machine is started, the samples are flexing around the pulley with frequency of 200 cycles/min for 30000 cycles. When the endurance cycles are finished, the samples are moved out off the pulleys and are being kept for a minimum of 12 hours at room temperature.

Measuring and calculation: Five cords are taken from the middle of each of the four samples and tested with Instron to determine the strength of each cord. Similarly, five cords are taken from the middle of the reference sample and tested as above. The retention is determined by dividing the average of 20 treated cord strengths after the endurance test by the average of 5 treated cord strengths kept as the reference.

Birefringence test: Birefringence was measured with a BEREK compensator (2061K from Leitz) using the darkest band available.

Thus, specific embodiments and applications of dimensionally stable yarns with improved fatigue strength retention have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A product comprising:

a dimensionally stable polymeric multifilament yarn having a decitex per filament count DPF of at least 7.5 and a fatigue strength retention FR, wherein the yarn is spun and drawn such that when DPF increases at least 100% over a reference yarn, and FR increases at least 19% absolute over the reference yarn; and wherein the reference yarn has a fatigue strength retention of 64% and a DPF of 3.7 with a twist multiplier of 19700.

2. The product of claim 1 wherein the multifilament yarn comprises a polyester.

3. The product of claim 1 wherein the polyester comprises poly(ethylene terephthalate).

4. The product of claim 3 wherein DPF is between 10 and 20.

5. The product of claim 4 wherein the yarn has a dimensional stability defined by $E_x$+TS of no more than 12.

6. The product of claim 4 wherein an adhesion active finish is applied to the yarn and the yarn has a dimensional stability defined by $E_x$+TS of no more than 11.

7. The product of claim 1 wherein the yarn is twisted or twisted in a cord and at least partially disposed within a rubber.

8. The product of claim 1 wherein the yarn is twisted or twisted in a cord, and the cord has a twist (single×cable TPM) of between 320 and 470 for an 1100 decitex yarn.

* * * * *